US005117615A

United States Patent [19]

Küng et al.

[11] Patent Number: 5,117,615

[45] Date of Patent: Jun. 2, 1992

[54] APPARATUS FOR TIGHTENING A STRIP AROUND A PACKAGE

[75] Inventors: Josef Küng, Muri; Nikolaus Stamm, Thalwil, both of Switzerland

[73] Assignee: A. Konrad Feinmechanik AG, Merenschwand, Switzerland

[21] Appl. No.: 568,502

[22] Filed: Aug. 15, 1990

[30] Foreign Application Priority Data

Aug. 15, 1989 [CH] Switzerland ..... 2979/89

[51] Int. Cl.[5] ..... B65B 13/18

[52] U.S. Cl. ..... 53/592; 53/582; 100/32

[58] Field of Search ..... 53/580, 582, 592; 156/494; 100/33 PB, 32

[56] References Cited

U.S. PATENT DOCUMENTS 3,984,278 10/1976 Styner ..... 53/582 X
4,488,926 12/1984 Rauch ..... 53/582
4,820,363 4/1989 Fischer ..... 156/494

*Primary Examiner*—John Sipos
*Attorney, Agent, or Firm*—Carl J. Evens

[57] ABSTRACT

The apparatus (4) manually operable with a tightening lever (16) has a cutting station (8), a tightening station (10) and a clamping station (12). The latter has a clamping arm (18) mounted on an eccentric shaft (20) and having a clamping shoe (40) through which the strip end (3) inserted in the strip channel (5) is clamped. The clamping shoe (40) is laterally displaced with respect to the axis of the eccentric shaft (20) in the direction of the strip end (3) in the vicinity of a clamping nose (35) supported on the supporting face (36) of the apparatus casing (15). On lowering the clamping shoe (18) into the clamping positioning an additional clamping force on the clamping shoe (40) is exerted by the clamping nose (35) guided on the supporting surface (36). The clamping force exerted by the clamping arm (18) acts under an acute angle (48), so that a toggle lever action by the clamping arm (18) is reliably avoided and consequently there is no overstressing of the casing (15) by uncontrollably high forces occurring in the toggle lever position.

12 Claims, 2 Drawing Sheets

Figure 4:
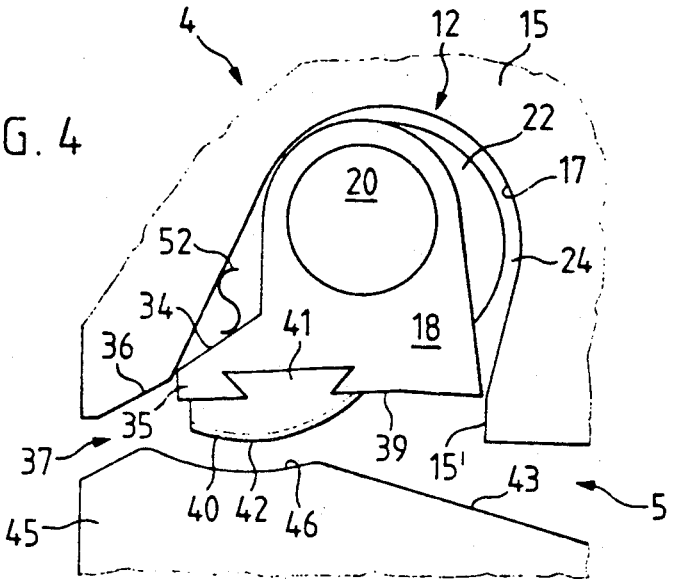

FIG. 1
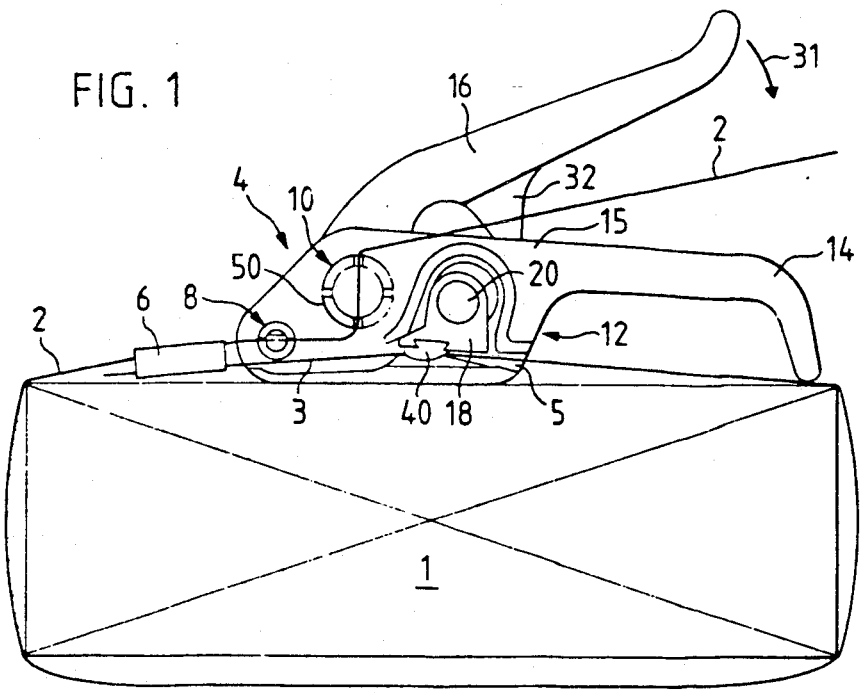
FIG. 2
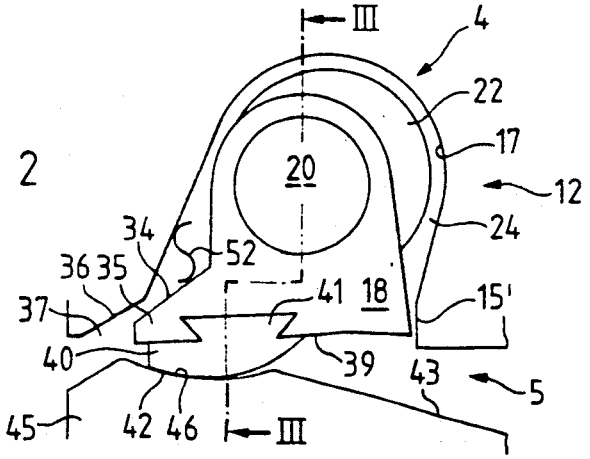
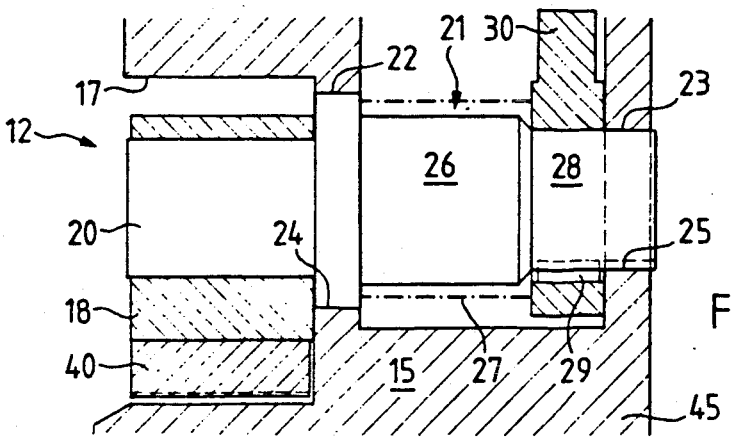
FIG. 3

APPARATUS FOR TIGHTENING A STRIP AROUND A PACKAGE

The invention relates to an apparatus for tightening a metallic or non-metallic strip to be placed round a package and in particular a plastic strip to be joined with a lead seal, the apparatus being provided with a clamping device, in which the securing of the strip end necessary for tightening purposes is brought about by means of a clamping arm provided with a clamping shoe and which is pivotably mounted on an eccentric shaft mounted by means of a bearing shaft in the casing of the apparatus and movable by the latter from a strip insertion position for inserting the strip in the apparatus into a clamping position for clamping the strip ends.

In connection with the passing of a strip round packages use is made of apparatuses in which said strip is firstly tightened or tensioned and then the strip ends are joined in the tensioned or tightened position. For joining the strip ends use is made of lead seals or buckles or in the case of plastic strips the strip ends can be joined by welding.

The degree of automation of said apparatuses differs significantly. In the case of a fully automated apparatus the strip is placed round the package, tightened and the strip ends joined in an automatic manner. Such apparatuses, which are provided with a motor drive are advantageous in certain fields, particularly for hooping large numbers of packages. However, there are also a number of fields where manually operable apparatuses are more advantageous. Also in the case of manually operable apparatuses embodiments are known, in which through the operation of one or more levers it is possible to automatically tighten and fit the lead seal and then the strip end is separated from the strip storage reel.

In other applications it is known to use a manually operable apparatus, which merely tightens the strip and separates the strip end from the reel. Prior to the separation of the strip end the superimposed strip ends are interconnected by using a lead seal or buckle, or by welding.

The invention relates to an apparatus of the latter type, in which initially following the manual placing of the strip round the package and inserting the strip end into the apparatus strip channel, the strip is passed through a tightening station and a cutting station. This is followed by the tightening of the strip by reciprocating the tightening lever of the apparatus. The strip ends are then joined to the lead seal by means of the lead sealing pliers, a buckle or a welding apparatus. The strip is then separated from the strip storage reel in the cutting station, followed by the removal of the apparatus.

So that the strip can be tightened, it is necessary to secure the strip end inserted in the strip channel. It is known for this purpose to provide at the apparatus a clamping station in which the strip end is secured by a clamping arm. The latter is operated by an eccentric shaft and by utilizing a toggle lever action between the eccentric shaft and the clamping arm a sufficiently high force can be produced to keep the strip reliably fixed even if it has still not been tightened or tensioned. If the strip is then tightened with the aid of the tightening lever, the tension exerted on the strip increases the angle decisive for the clamping action, so that a reliable fixing of the strip is ensured. However, this increase in the said angle can lead to overstressing and to damage to the apparatus as a result of the associated difficultly controllable maintenance of the forces which increase greatly as a result of small angular changes. Although said angle can be limited by means of a stop member, the force may no longer be adequate for fixing the strip.

The problem of the present invention is to so further develop an apparatus of the aforementioned type that on the one hand even at the start of tensioning an adequately large clamping force is made available through the clamping station, but on the other hand during the tightening of the strip the clamping arm reliably secures the strip end, without reaching a clamping arm angular position at which the aforementioned, difficultly controllable, high forces occur.

According to the invention this problem is solved in that at its free end the clamping arm is provided with a clamping nose extending in the direction of the strip end and with whose back the clamping arm is movable in the clamping position for producing an increased strip clamping force against an inclined supporting surface of the casing, which defines a gap formed on the casing and which tapers in the direction of the strip end.

Thus, on moving the eccentric shaft by the engagement of the clamping nose or projection on the sloping supporting surface, a keying action is obtained on lowering the clamping shoe and simultaneously the eccentric can be brought into a position in which it brings about a self-locking of the clamping arm.

The invention is described in greater detail hereinafter relative to a non-limitative embodiment and the attached drawings, wherein show:

FIG. 1 A diagrammatically represented side view of an apparatus for tightening a strip placed around a package.

FIG. 2 A diagrammatic, larger-scale side view of the clamping station for the apparatus according to FIG. 1, with the latter in the inoperative position.

FIG. 3 A section along line III—III in FIG. 2.

FIG. 4 A diagrammatic, larger-scale side view of the clamping station in the position for inserting the strip end into the strip channel.

Figure 5:
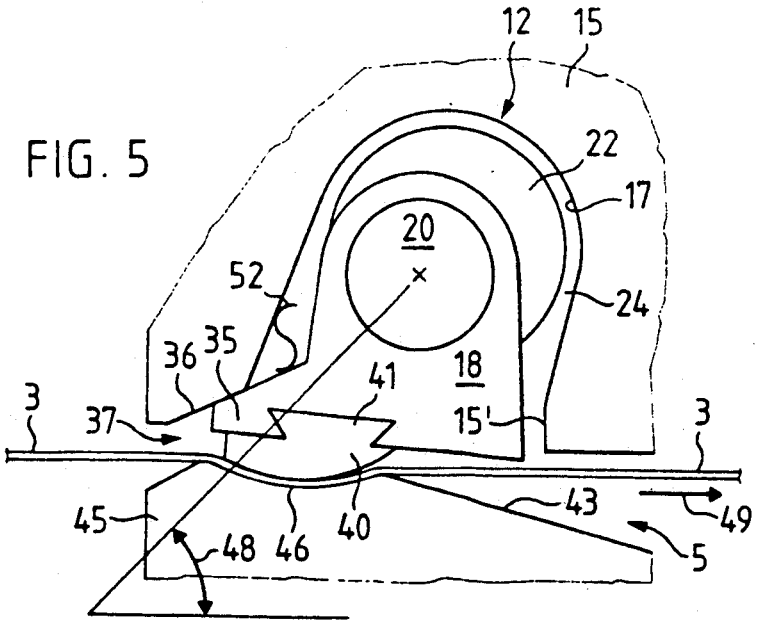

FIG. 5 A diagrammatic, larger-scale side view of the clamping station in the clamping position with the strip tensioned.

In FIG. 1, 1 is a package, parcel, etc. around which is manually placed a strip, whose end 3 is inserted in an apparatus 4 for tightening or tensioning said strip 2. The strip end 3 is located in a strip channel 5, cf. also FIG. 4 and projects so far out of the strip channel that it can be joined to the strip 2 by means of a lead seal 6. The strip 2 unwound from a not shown strip supply means extends through a cutting station 8 and a tightening station 10. Above the strip channel 5 is arranged a clamping station 12 with the aid of which the strip end 3 can be clamped, in order to permit a tightening of said strip 2.

The cutting station 8, the tightening station 10 and the clamping station 12 are incorporated into a casing, which is equipped with a handle 14. In the casing 15 is also pivotably mounted a tightening lever 16, which can be manually reciprocated for operating a not shown chute.

FIGS. 2 and 3 show the clamping station 12 in the inoperative position. The term inoperative position is understood to mean that position of the apparatus 4, in which the clamping lever 16 is located in the position shown in FIG. 1, where no action is exerted on the tightening station 12.

As can be gathered from FIGS. 2 and 3 there is a recess 17 in the casing 4 and serves to receive a clamping arm 18. The clamping arm 18 is mounted on an eccentric shaft 20 so as to be easily rotatable and said shaft 20 is eccentrically positioned relative to a bearing shaft 21 and is fixed thereto.

The bearing shaft 21 is mounted in rotary manner by means of bearing portions 22, 23 in bearing bores 24, 25. Between the bearing portions 22, 23 is provided a guide part 26 for an only diagrammatically shown torsion spring 27 and a fixing part 28 for a detent 30, which is fixed to the fixing part 28, e.g. by a keyed joint 29.

If the clamping lever 16 is pressed down in the direction of the arrow 31 it presses with a cam 32 on the detent 30 and consequently tensions the torsion spring 27, whose one end is supported on the detent 30 and whose other end is supported on the casing 15. On pressing down the detent 30 the clamping arm 18 is raised by the eccentric shaft 20, cf. FIG. 4 and the torsion spring 27 is tensioned, so that on releasing the tightening lever 16 the detent 30 is rotated by the action of the torsion spring 27 and consequently the bearing shaft 21, so that the clamping arm 18 is lowered into the inoperative position shown in FIG. 2. The clamping arm 18 has a clamping nose or projection 35 projecting in the direction of the strip end 3 and its back 34 is intended to be supported on a sloping supporting surface 36 arranged at the end of the recess 17.

The supporting surface 36 defines a tapering gap 37 of the strip channel 5 and guides and presses down the clamping nose 35, so that at the start of the tensioning of the strip 2, the strip end 3 can be reliably clamped by self-closure of the clamping nose 35 on the supporting surface 36.

In the vicinity of the clamping nose 35 on the underside 39 of the clamping arm 18 a clamping shoe 40 is fixed by means of a dovetail guide 41. The underside of the clamping shoe 40, which can have a convex shape, forms a supporting surface 42, which can be provided with gripping projections for obtaining the self-closure with the strip end 3, e.g. grooves or teeth.

On the side opposite to the underside 39 of the clamping arm 18, the strip channel 5 is bounded by a wall 43 of a base plate 45, which forms a part of the casing 15. A part of the wall 43 is constructed as a clamping surface 46 in the vicinity of the supporting surface 42 and can have a concave shape in order to adapt to the convex shape of the supporting surface 42. It can optionally also be provided with gripping projections, e.g. in the form of grooves or teeth.

FIG. 5 shows the clamping arm 18 in the clamping position, in which the clamping shoe 40 presses the strip end 3 onto the clamping surface 46 of the wall 43, the clamping nose 35 being forced into the gap 37 along the supporting surface 36 by the eccentric drive loaded by the torsion spring 27.

As a result of the projecting clamping nose 35, the clamping point of the strip end 3 is located laterally of the axis of the eccentric shaft 20, so that the force with which the eccentric drive loaded by the torsion spring 27 presses the clamping arm 18 with the clamping shoe 40 under a relatively small angle 48 onto the strip end 3 is small. However, as the clamping nose 35 guided on the supporting surface 36 exerts an additional force on the clamping arm 18, despite the strip tension exerted on the strip in the direction of the arrow 49, the strip end is still reliably clamped. It is not necessary to press the clamping arm 18 onto the strip end 3 in a direction such that the angle 48 is so large that uncontrollably high forces could occur due to the toggle lever action.

Since through the described clamping station 12 toggle lever-like force actions of the clamping arm 18 are reliably avoided, no correspondingly high stresses can occur on the casing. This makes it possible to produce the casing 15, the clamping shoe 18, the eccentric shaft 20, the bearing shaft 21, the detent 30 and the tightening lever 16 from a suitable plastics material. This makes it possible to produce the bearing portions 22, 23 and the bearing bores 24, 25 as simple sliding gaps, as can be gathered from FIG. 3.

As stated, the tightening lever 16 is mounted on a not shown shaft with a ratchet comprising a gear and a retaining pawl. This shaft carries a tensioning or tightening drum 50, which represents the tightening element of the tightening station 10. Through pivoting movements of the tightening lever 16 the tightening drum 50 is only moved in one direction, so that the strip 2 is placed around the drum 50 and is consequently tightened.

The hooping of a package 1 with a strip 2 is carried out in the following way. Firstly the tightening lever 16 is completely pressed down in the direction of arrow 31, so that as a result of the cam 32 the detent 30 rotates and consequently the clamping arm 18 is raised into the strip insertion position shown in FIG. 4 due to the movement of the eccentric shaft 20. As a result the strip channel 5 is free througout and the strip end 3 can be inserted, the latter being advanced to such an extent that it is covered by the lead seal 6. The tightening lever 16 is now released so that, as a result of the action of the torsion spring 27 through detent 30 it can be pivoted into the position shown in FIG. 1. The clamping arm 18 has dropped and the clamping nose 35 is pressed into the gap 37 and in this way clamps the strip end 3, cf. FIG. 5. The strip 2 is now placed around the package 1 and guided by the cutting station 8 and the tightening station 10. As a result of the reciprocating movements of the tightening lever 16 the strip is now placed round the tightening drum 50 and is consequently tightened. Immediately alongside the casing 15 the lead seal 6 is now placed on the strip 2 and the strip end 3 and the two strips are joined by means of lead sealing pliers. By pressing down the tightening lever 16 in the direction opposite to that of arrow 31, the cutting edge of the cutting station 8 is operated and consequently the strip 2 is separated from the not shown strip supply means.

So that the clamping arm 18 is always directed downwards against the strip channel 5, even if the apparatus 4 is pivoted into a position other than that in FIG. 1, a leaf spring 53 is fixed to the back 34 of the clamping nose and is supported on the wall of the recess 17 and forces the clamping arm 18 into the position shown in FIG. 4. This is bounded by a further supporting surface 15' of the casing 15, so that the clamping arm 18 cannot assume a large angle 48, i.e. towards 90° with respect to the wall 43 of the base plate 45, so that the maximum explosive forces which occur are limited. Obviously the tension of this spring is only small, so that the pressing of the clamping nose 35 into the gap 37 for exerting the clamping action is not impeded.

The described apparatus 4 has a simple construction. As it is reliably able to prevent uncontrollable stressing peaks caused by the toggle lever action of the clamping arm 18, the apparatus can have a lightweight construction. On releasing the clamping arm 18 out of the clamping position, the clamping shoe 40 is moved in the strip tension direction 49, so that it is easier to release the positive hooking of the clamping shoe 40 on the strip end 3. The maintaining of an acute clamping angle 48 permits a smaller lever travel, so that the tightening lever 16 can be more easily enveloped.

We claim:

1. Apparatus for tightening a metallic or non-metallic strip to be placed round the package and in particular a plastic strip to be joined with a lead seal, the apparatus being provided with a clamping device, in which the securing of the strip end necessary for tightening purposes is brought about by means of a clamping arm provided with a clamping show and which is pivotably mounted on an eccentric shaft mounted by means of a bearing shaft in the casing of the apparatus and movable by the latter from a strip insertion position for inserting the strip in the apparatus into a clamping position for clamping the strip ends, characterized in that at its free end the clamping arm is provided with a clamping nose extending in the direction of the strip end the front of which carries said clamping shoe and having an inclined back surface opposite said front, said casing having an inclined supporting surface tapering in the direction of the strip end and defining a gap in the casing for said clamping nose, means for moving said clamping arm to the clamping position with its back against said inclined supporting surface of the casing in the gap for producing an increased strength clamping force by said clamping shoe.

2. Apparatus according to claim 1, characterized in that the clamping arm is positioned in a recess of the casing, which is shaped in such a way that the clamping arm is essentially guided on the recess wall in its movement out of the insertion position into the clamping position and back again.

3. Apparatus according to claim characterized in that below the recess in the casing is formed a strip channel for the insertion of the strip end and which is formed from above through the casing and the underside of the clamping arm raised into the insertion position and from below by a wall of a base plate arranged in the casing.

4. Apparatus according to claim 1, characterized in that the clamping shoe is arranged on an underside surface of the clamping arm and is fixed to the latter.

5. Apparatus according to claim 4, characterized in that the clamping shoe extends into the vicinity of the clamping nose.

6. Apparatus according to claims 4 characterized in that the underside surface of the clamping shoe is provided with a clamping surface provided with gripping projections.

7. Apparatus according to claim 6, characterized in that the clamping surface has a convex surface.

8. Apparatus according to claim 3, characterized in that the wall of the base plate has a clamping surface in the strip channel in the vicinity of the clamping shoe.

9. Apparatus according to claim 8, characterized in that the clamping surface in the wall of the base plate is provided with gripping projections is constructed as a concave surface.

10. Apparatus according to claim 6, characterized in that the clamping surfaces of the clamping shoe and the wall of the base plate cooperating therewith on clamping the strip end are so forwardly displaced in the direction of the strip end, that the clamping force exerted by the clamping arm acts under an acute angle to said clamping surfaces.

11. Apparatus according to claim 1, further comprising a tightening lever and a casing handle and characterized in that a leaf spring is fixed to the back of the clamping nose and is supported on the wall of the recess and forces the clamping arm into a direction opposite to the strip end, so as to keep as small as possible in the inoperative position the opening angle between the tightening lever and the casing handle.

12. Apparatus according to claim 1, characterized in that a further supporting surface on the casing limits the angle of the clamping arm in order to limit the maximum explosive forces which occur.

* * * * *